US006444888B1

(12) United States Patent
VanDruff

(10) Patent No.: US 6,444,888 B1
(45) **Date of Patent: *Sep. 3, 2002**

(54) MUSICAL COMPUTER KEYBOARD APPARATUS AND METHOD

(76) Inventor: Dean VanDruff, 3654 Fore Cir., Dallas, TX (US) 75234

( * ) Notice: Subject to any disclaimer, the term of this patent is extended or adjusted under 35 U.S.C. 154(b) by 0 days.

This patent is subject to a terminal disclaimer.

(21) Appl. No.: 09/816,939

(22) Filed: Mar. 23, 2001

(51) Int. Cl.[7] ..... A63H 5/00; G04B 13/00; G10H 7/00; G10C 3/12

(52) U.S. Cl. ..... 84/609; 84/649; 84/719; 84/744; 84/423 R

(58) Field of Search ..... 84/600, 609, 615, 84/645, 649, 653, 719–720, 744–745, 18, 20, 25, 423 R, 424, 433, 442, 446

(56) References Cited

U.S. PATENT DOCUMENTS

| | | | | |
|---|---|---|---|---|
| 2,040,248 A | | 5/1936 | Dvorak | |
| 3,067,645 A | * | 12/1962 | Moschino | 84/423 R |
| 4,031,800 A | | 6/1977 | Thompson | |
| 4,352,313 A | | 10/1982 | Ny | |
| 4,655,177 A | | 4/1987 | Roose | |
| 4,704,940 A | | 11/1987 | Cummings | |
| 5,036,745 A | | 8/1991 | Althof | |
| 5,088,378 A | | 2/1992 | DeLaTorre | |
| 5,646,648 A | | 7/1997 | Bertram | |
| 5,741,990 A | * | 4/1998 | Davies | 84/423 R |
| 5,971,635 A | * | 10/1999 | Wise | 84/425 |
| 6,063,994 A | * | 5/2000 | Kew et al. | 84/600 |
| 6,066,795 A | * | 5/2000 | Hara | 84/645 |

OTHER PUBLICATIONS

IEEE Spectrum: "Electronic Music, New Ways to Play", Dec. 1997. A technology trend overview. Available online at: http://www.spectrum.ieee.org/select/1297/muse.html.

Craig Peacock, "PC Keyboard Theory", 2.28.2000, online article at: http://www.beyondlogic.org/keyboard/keybrd.htm.

Marshall Brooks, "How to Hack a Keyboard", online article, date uncertain. Info on multi–key depression sensing, ghosting, and solutions at: http://www.mameworld.net/emuadvice/keyhack2.html.

Mark Schultz, et al: "AT Keyboard Interface", 08.16.1996, online article at: http://www.arne.si/~mauricio/Kbdfaq.htm.

Amy Bauer, "Music Theory Glossary", date uncertain, online at: http://cctr.umkc.edu/~bauera/Gloss.html.

Harp On: "Music Theory 1", date uncertain, online article at: http://www.angelfire.com/music/HarpOn/theory1.html.

CTiME: "A Brief History of Music Technology", 4.16.1997, online at: http://www.netdays–wm.org.uk/ctime/techist.htm.

120 Years of Electronic Music: "The Theremin", date uncertain, http://www.obsolete.com/120_years/machines/theremin.

* cited by examiner

*Primary Examiner*—Marlon T. Fletcher

(57) ABSTRACT

An apparatus and method to change the mode of computer keyboard use from alpha-numeric language orientation to become a musical input keyboard where the keys change meaning for this purpose is provided. The apparatus and method implements a unique musical mapping for a standard computer keyboard such that the musical notes that are most often used in musical composition are mapped to keys of a home row of the standard keyboard. Musical notes that are the next most often utilized in musical composition are mapped to keys in the rows above and below the home row. All other musical notes are mapped based on their relative probability of being used in combination with the notes mapped in the home row and the rows above and below the home row.

20 Claims, 4 Drawing Sheets

| Halfsteps (Chromatic) | Generic Note (Solfege) | Scale Degree (Diatonic) | Key Name (Relationship) | Key of C example | Key of A example |
|---|---|---|---|---|---|
| 1 Tonic (T) | do | I | Tonic | C | A |
| 2 | | | | C# | A# |
| 3 | re | ii | Supertonic | D | B |
| 4 | | | | D# | C |
| 5 | mi | iii | Mediant | E | C# |
| 6 | fa | IV | Subdominant | F | D |
| 7 | | | | F# | D# |
| 8 | sol | V | Dominant | G | E |
| 9 | | | | G# | F |
| 10 | la | vi | Sbmediant | A | F# |
| 11 | | | | A# | G |
| 12 | ti | vii | Leading Tone | B | G# |
| $T^{+1}$ (Octave) | do | $I^{+1}$ (Octave) | Tonic (+1 ETC.) | $C^{+1}$ | $A^{+1}$ |

FIG. 4

MUSICAL COMPUTER KEYBOARD APPARATUS AND METHOD

BACKGROUND OF THE INVENTION

1. Technical Field

The present invention is directed to a musical computer keyboard. More specifically, the present invention is directed to an apparatus and method to change the mode of computer keyboard use from alph-anumeric language orientation to become a musical input keyboard where the keys change meaning for this purpose.

2. Description of Related Art

In the past, the control of and performance of computer synthesized music and/or computer actuated acoustic musical instruments has been achieved principally via traditional music input devices which are externally coupled to the computer. Typically, these are external piano or organ keyboards which communicate with a computer using a standardized communication protocol such as the Musical Instrument Digital Interface (MIDI).

MIDI is a standard protocol for the interchange of musical information between musical instruments, synthesizers and computers. It defines the codes for a musical event, which includes the start of a note, the pitch, length, volume, and musical attributes.

With external keyboard systems, however, a user who wishes to generate music using a computer must make a large economic investment in the tools necessary to do so. For example, the user must purchase a MIDI enabled piano or organ keyboard, a MIDI card for insertion into his/her computer, software for use with the MIDI card, and possibly even the computer itself. Thus, users must make a large capital investment via multiple pieces of hardware and software in order to input extemporaneous musical notes into a computer where sounds can then be generated, the notes be edited, and the like.

The present state of the art is that sounds, music and/or musical arrangements on computers can be edited and modified using Language Based Typing and/or Character Commands (LBT/CC), Graphical User Interfaces (GUIs), and/or Mouse Based (MB) functions along with music editing software. With such music editing software, the editing functions typically include a user perceiving a representation of the music on a display (such as in the form of a waveform or a musical score) and making modifications to the music by selecting portions of the representation and issuing modifying commands to the music editing software to thereby modify the selected portion of the music. While such music editing software does allow the user to input and modify music with or without an external instrument, the process is too cumbersome to be of extemporaneous or real-time performance use since it is done via LBT/CC language based typing, GUI manipulation, or MB manipulation.

Computer keyboard use to play musical notes into a computer has been implemented in the past, such that the implementation and advantages of the present invention can be understood by those of ordinary skill in the art.

The two major drawbacks of previous embodiments within the art have been: 1) the limitation of mapping of the keys to mimic traditional instruments, and/or: 2) key mapping that is easy to understand, but difficult to play.

On drawback 1, the mimicking of traditional instrument layouts onto the computer keyboard creates obvious inefficiencies in the use of keys. A simple explanatory analogy would be the proverbial "like putting a square peg into a round hole". Most typically, it is the piano keyboard layout that is mimicked, as in U.S. Pat. Nos. 6,066,795, 5,646,648, 4,704,940, and 4,352,313. Thus, a selected row of keys is used like the "white keys" of a piano or organ, and where there would be a "black key" on the piano keyboard the keyboard key just above and in-between the mapped "white keys" are used, and where there are no "black keys" on the piano keyboard these keys are not used. U.S. Pat. No. 5,036,745 mimics a woodwind layout, for yet another instrument example. The obvious drawback of this approach is that it severely limits the potential octave range of the keyboard in its fixed state: i.e. without using command keys in real time to shift the resultant limited range up or down to achieve some reasonable octave span. This renders such embodiments unfit for much use beyond solo voicing or novelty value.

As for the second prior art drawback mentioned above, some musical computer keyboard implementations aim to make it easy to know or remember where notes are placed by mapping them sequentially across rows. A simple analogy of this strategy would be to imagine a typewriter keyboard mapping which followed the alphabet from left to right across rows. In the case of musical note layout, this simplicity is a high price to pay for the awkward playability that results. Examples are U.S. Pat. Nos. 5,088,378, 4,704,940, and 4,655,117, where the musical notes are merely sequentially placed across rows. U.S. Pat. No. 5,088,378 is notable as to drawback 1 as well, in that it essentially mimics an accordion where the left hand plays the "bass chord" and the right hand a melody based on a simple but awkward escalation of notes across rows.

Given the above limitations, external MIDI connected piano and organ keyboards still dominate the art. While the above mentioned patents demonstrate that using a computer keyboard is inherently plausible, the note mapping used fails to provide enough octave range or finger motion fluidity to make such methods or apparatus viable as real musical instruments that people will take the time to learn, master, and use as a matter of choice.

SUMMARY OF THE INVENTION

The present invention provides an apparatus and method to change the mode of computer keyboard use from alphanumeric language orientation to become a musical input keyboard where the keys change meaning for this purpose. The present invention implements a unique musical mapping for a standard computer keyboard such that the musical notes that are most often used in musical composition are mapped to be on or near the keys of a home row of the standard keyboard. Musical notes that are the next most often utilized in musical composition are mapped to keys in the rows above and below the home row. All other musical notes are mapped based on their relative probability of being used in combination with the notes mapped in the home row and the rows above and below the home row.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 4 is an exemplary table of a Major Key layout which explains the notations used in FIGS. 3, 5, and 6 and how these relate to various musical notation conventions for one exemplary embodiment of the present invention;

DETAILED DESCRIPTION OF THE PREFERRED EMBODIMENT

The present invention provides a strategic mapping of notes, termed: Modal Computer Keyboard Format for Control of Musical Instruments (MCKFCMI). The MCKFCMI methodology makes use of a standard computer keyboard, i.e. a QWERTY keyboard (which refers to the first six letters of a English-language keyboard read from the top left, and is a colloquial way of referring to the standard computer keyboard) as the mechanism to play the musical instrument. An example keyboard is the AT keyboard used on many Personal Computers (PC). The MCKFCMI methodology maps musical notes to keys on the standard computer keyboard such that when a key is pressed on the keyboard, the mapping causes a musical note output. By pressing a plurality of keys at substantially the same time, a chord or other musical output may be generated based on the mapping of the MCKFCMI methodology.

Figure 1A:
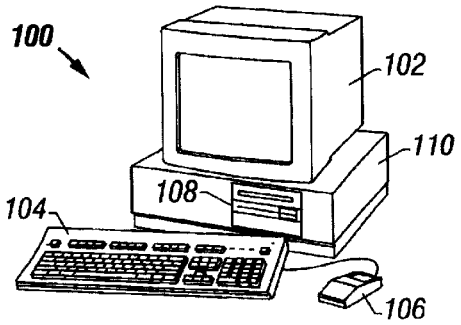
FIG. 1A is an exemplary block diagram of a data processing system in which the present invention may be incorporated, in accordance with one exemplary embodiment of the present invention.

With reference now to the Figures and in particular with reference to FIG. 1, a pictorial representation of a data processing system in which the present invention may be implemented is depicted in accordance with a preferred embodiment of the present invention. A computer 100 is depicted which includes a system unit 110, a video display terminal 102, a keyboard 104, storage devices 108, which may include floppy drives and other types of permanent. and removable storage media, and mouse 106. Additional input devices may be included with personal computer 100, such as, for example, a joystick, touchpad, trackball, microphone, external MIDI instruments, music recording media, and the like. Computer 100 can be implemented using any suitable computer, such as an IBM PC or Apple Macintosh. Although the depicted representation shows a computer, other embodiments of the present invention may be implemented in other types of data processing systems, such as a network computer or notebook computer. Computer 100 also preferably includes a graphical user interface that may be implemented by means of systems software residing in computer readable media in operation within computer 100.

Figure 1B:
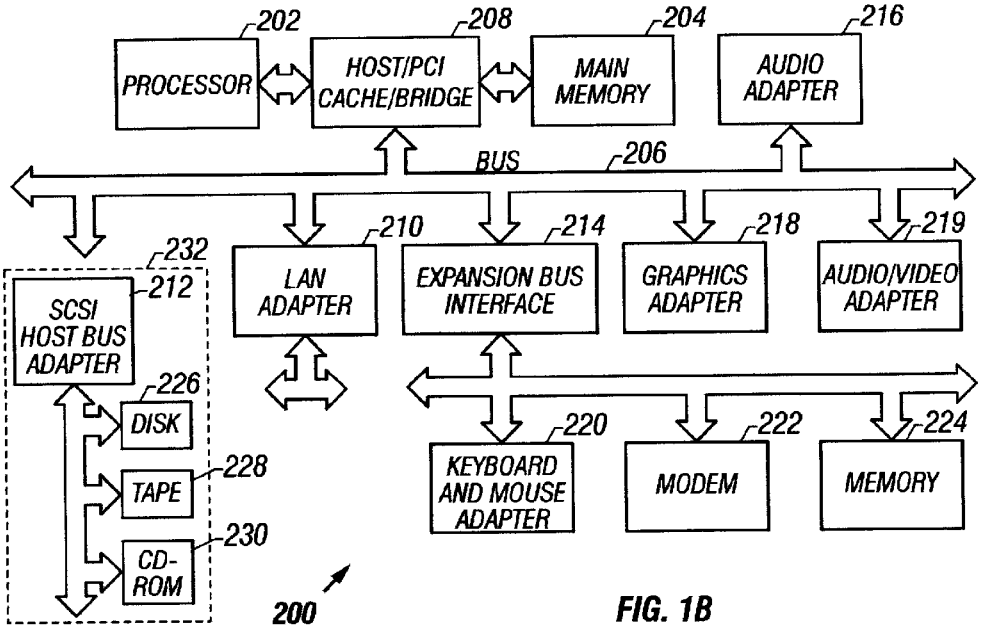
FIG. 1B is an exemplary block diagram of the internal structure of the data processing system shown in FIG. 1A.

With reference now to FIG. 1B, a block diagram of a data processing system is shown in which the present invention may be implemented. Data processing system 200 is an example of a computer, such as computer 100 in FIG. 1, in which code or instructions implementing the processes of the present invention may be located. Data processing system 200 employs a Peripheral Component Interconnect (PCI) local bus architecture. Although the depicted example employs a PCI bus, other bus architectures such as Accelerated Graphics Port (AGP) and Industry Standard Architecture (ISA) may be used. Processor 202 and main memory 204 are connected to PCI local bus 206 through PCI bridge 208. PCI bridge 208 also may include an integrated memory controller and cache memory for processor 202. Additional connections to PCI local bus 206 may be made through direct component interconnection or through add-in boards. In the depicted example, Local Area Network (LAN) adapter 210, Small Computer System Interface (SCSI) host bus adapter 212, and expansion bus interface 214 are connected to PCI local bus 206 by direct component connection. In contrast, audio adapter 216, graphics adapter 218, and audio/video adapter 219 are connected to PCI local bus 206 by add-in boards inserted into expansion slots. Expansion bus interface 214 provides a connection for a keyboard and mouse adapter 220, modem 222, and additional memory 224. SCSI host bus adapter 212 provides a connection for hard disk drive 226, tape drive 228, and CD-ROM drive 230. Typical PCI local bus implementations will support three or four PCI expansion slots or add-in connectors.

An operating system runs on processor 202 and is used to coordinate and provide control of various components within data processing system 200 in FIG. 1B. The operating system may be a commercially available operating system such as Windows 2000, which is available from Microsoft Corporation. An object oriented programming system such as Java may run in conjunction with the operating system and provides calls to the operating system from Java programs or applications executing on data processing system 200. "Java" is a trademark of Sun Microsystems, Inc. Instructions for the operating system, the object-oriented programming system, and applications or programs are located on storage devices, such as hard disk drive 226, and may be loaded into main memory 204 for execution by processor 202.

Those of ordinary skill in the art will appreciate that the hardware in FIG. 1B may vary depending on the implementation. Other internal hardware or peripheral devices, such as flash ROM (or equivalent nonvolatile memory) or optical disk drives and the like, may be used in addition to or in place of the hardware depicted in FIG. 1B. Also, the processes of the present invention may be applied to a multiprocessor data processing system.

For example, data processing system 200, if optionally configured as a network computer, may not include SCSI host bus adapter 212, hard disk drive 226, tape drive 228, and CD-ROM 230, as noted by dotted line 232 in FIG. 1B denoting optional inclusion. In that case, the computer, to be properly called a client computer, must include some type of network communication interface, such as LAN adapter 210, modem 222, or the like. As another example, data processing system 200 may be a stand-alone system configured to be bootable without relying on some type of network communication interface, whether or not data processing system 200 comprises some type of network communication interface.

The depicted example in FIG. 1B and above-described examples are not meant to imply architectural limitations.

For example, data processing system 200 also may be a notebook computer or stand-alone keyboard with an LCD display built in. Data processing system 200 also may be a kiosk or a Web appliance.

The processes of the present invention are performed by processor 202 using computer implemented instructions, which may be located in a memory such as, for example, main memory 204, memory 224, or in one or more peripheral devices 226–230.

As mentioned above, the present invention makes use of a standard computer keyboard as a means by which the mapping of the MCKFCMI methodology may output musical notes in real-time. Thus, the MCKFCMI enabled computer keyboard may be used as a musical instrument in itself. Because the MCKFCMI enabled computer keyboard acts, in most respects, the same as a standard computer keyboard, a brief description of the manner by which a standard computer keyboard operates will now be provided in order to provide a context in which the present invention may be understood.

A standard computer keyboard operates by providing a matrix of electrical connections below keys which may be actuated by a user. When a user actuates a key, e.g., by pressing the key with the user's finger, the depression of the key causes a short in the electrical connection beneath the actuated key. The short is identified by the computer to which the keyboard is connected as an interrupt command which is continued until the key is released. Based on the position of the key on the keyboard, and thus, the particular electrical connection that is shorted, the computer is able to identify which key was depressed by the user and perform appropriate action, such as display a letter on the display screen corresponding to the letter printed on the actuated key.

The present invention makes use of this standard operation of a keyboard but provides a unique and alternative mapping of the standard computer keyboard such that the keyboard may be used to output musical notes. Furthermore, the particular mapping of the musical notes to the keys on the keyboard is selected in such a manner as to map musical notes that are most often played to keys that lie under the fingers of the user when the user places his/her fingers over the keyboard in a manner generally used for typing documents. For example, the musical notes that are most often played in a particular musical Key are mapped to the QWERTY keys A, S, D, F, G, H, J, K, L, and ; on the middle row, i.e. the "home" row, of the standard computer keyboard.

Musical notes that are next most likely to be played are mapped to keys positioned below or above the home row. In this way, the keys in the home row are mapped to musical notes that may be used to generate a chord or create a melody out of the notes that would make up a Major chord. Other musical notes are mapped in such a way as to place them in positions based on the natural flow of actuation by a user whose hands are in the home row position in correspondence with the likelihood they will be played based on melody and chord construction.

The most likely chord progressions from the base, or "Tonic" chord are the Dominant and Subdominant chord progressions. The Dominant chord, using the musical note mapping of the preferred embodiment, is generated by pressing one key in the home row and two keys in the next row up in as convenient a way as possible to access while. still being roughly sequential from left to right, for example. The Subdominant chord, using the musical note mapping of the preferred embodiment, is generated by pressing one key in the home row and two keys from the row below the home row in a similar fashion, for example.

With the musical note mapping described above, a standard keyboard may be mapped to provide the ability to play musical notes within four octaves without having to actuate a key to switch octaves.

Figure 2:
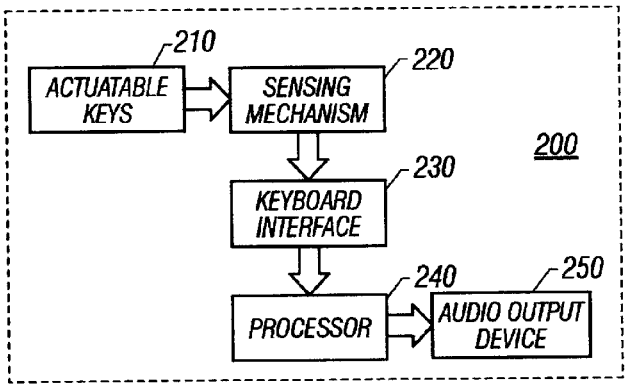
FIG. 2 is an exemplary block diagram of the major components of the present invention.

FIG. 2 is an exemplary block diagram illustrating the primary components of the musical computer keyboard in accordance with the present invention. As shown in FIG. 2, the musical computer keyboard 200 includes the actuatable keys 210, a sensing mechanism 220 coupled to a keyboard interface 230, a processor 240, and an audio output device 250. With the present invention, the physical actuation of keys 210 of the keyboard is detected by the sensing mechanism 220, which generates signals that are sent to the keyboard interface 230.

The keyboard interface 230 interprets the signal as representing a particular keystroke and forwards this keystroke information to the processor 240. The processor 240 receives the keystroke information from the keyboard interface and applies a keyboard mapping to the received keystroke information resulting in a musical note output signal until the key is released. The musical note output signal is then sent to the audio output device which outputs a musical note corresponding to the musical note output signal and duration.

The components 210–250 may be incorporated into a stand alone device or may be distributed across a plurality of devices. For example, the actuatable keys 210, sensing mechanism 220 and keyboard interface 230 may be part of a standard computer keyboard while the processor 240 and audio output device 250 may be part of a computer to which the standard computer keyboard is coupled. Alternatively, all of the components 210–250 may be incorporated into a stand-alone computer keyboard that is capable of processing the keystrokes to generate a musical output in the manner described hereafter.

The musical note mapping of the present invention may be implemented as software, hardware, or a combination of software and hardware. For example, the musical mapping may be implemented as software instructions executed by a processor. Alternatively, the musical mapping may be hardwired into a hardware circuit through which keyboard input is passed. Moreover, the musical mapping of the present invention may make use of a data structure in which received keyboard input may be "looked-up" to determine an appropriate musical note output. The detected notes played may be put into MIDI format or some other standard data format and passed on to commercially available music generation software; or sound generation software may be written to interpret MCKFCMI keystrokes directly. Other implementations of the present invention in software, hardware, or a combination thereof, may be used without departing from the spirit and scope of the present invention.

Figure 3:
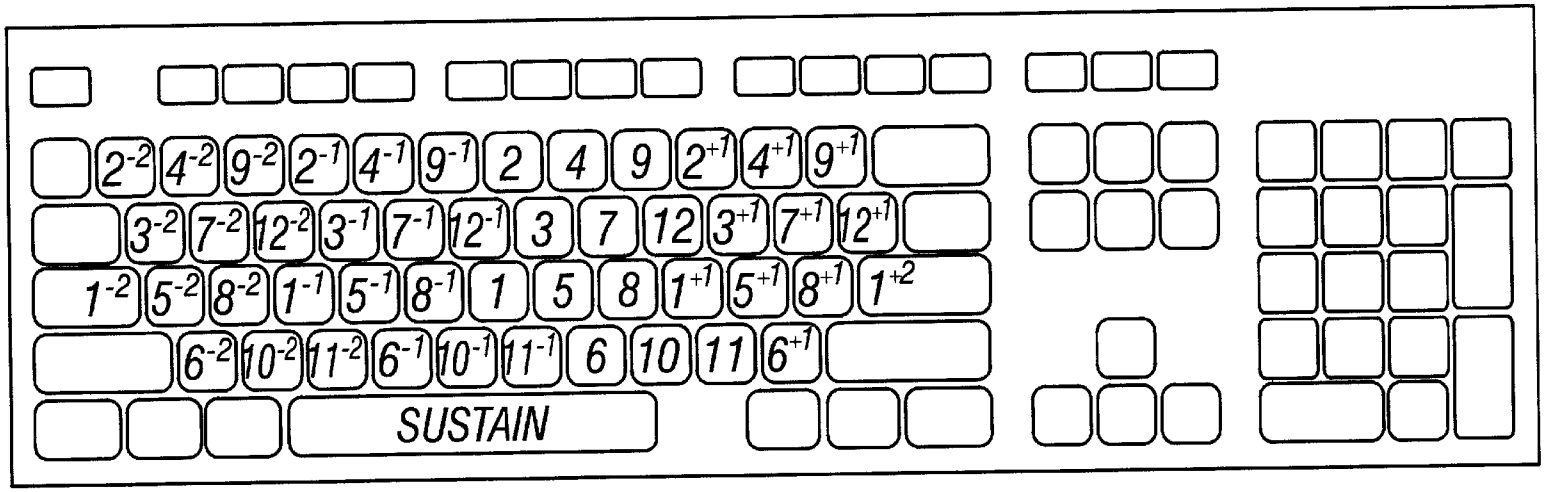
FIG. 3 is an exemplary illustration of a generic Major Key layout (musical Keys, e.g. playing a song "in the Key of", will be capitalized so as not to be confused with keyboard keys. Musical notations such as "Major" and "Minor" that could be confused with normal English meaning will also be capitalized) according to one exemplary embodiment of the present invention.

FIG. 3 is an exemplary illustration of a generic Major Key layout of the MCKFCMI in accordance with one exemplary embodiment of the present invention. The actual Key could be any base (Tonic) note (examples given in a moment) but this shows the generic pattern, progression, and relationship. The symbols used are Chromatic halfsteps as explained in FIG. 4.

In these Figures and description, musical octaves are depicted using exponential notation such as $3^{+1}$ or $3^{-1}$, $T^{+2}$ or $T^{-2}$, and $C^{+1}$ or $C^{-1}$—for example—to designate the notes relationship to the "Middle" or base Key row, which is the octave just under the normal "home" finger placement of the right hand. The absence of an exponent designates being in the base or Middle Key octave.

As shown in FIG. 3, the MCKFCMI key-mapping is designed to provide a keyboard layout that allows musical notes over four octaves to all be readily accessed. The most likely played notes in the musical scale are designated by the Chromatic numbers 1, 5 and 8 which represent the do/I/Tonic, mi/iii/Mediant, and sol/V/Dominant musical notes within that Key. The next most likely played notes are represented by the Chromatic numbers 3, 8, and 12 which represent the re/ii/Supertonic, sol/V/Dominant and ti/vii/Leading tones. The next most likely notes to be played are designated by Chromatic numbers 6, 10 and $T^{+1}$ (Tonic$^{+1}$, the base Tone note one octave higher) which correspond to the fa/IV/Subdominant, la/vi/Submediant, and do/$I^{+1}$/octave tones. The keys that are the least likely to be played are designated by the Chromatic numbers 2, 4 and 9, so these are placed at the top. For the sake of rough sequentially and fluent access Chromatic notes 7 and 11 are placed one row up from home and one row down, respectively.

As shown in FIG. 3, all 12 Chromatic notes are accessible in a compact hand-size space with the Diatonic notes strategically located. The notes most likely to start off a musical score or form a Major chord are conveniently placed just under the user's hands when positioned over the home row in a manner generally used by individuals familiar with proper typing position on a keyboard. The musical notes that are next most commonly used, and thus, typically used in conjunction with the musical notes mapped to the home row to generate musical chords, are mapped to locations that are easily actuatable by a user whose hands are in a home row position. This pattern repeats itself up and down the keyboard.

The present invention is not limited to the layout set forth above and other mappings may be used without departing from the spirit and scope of the present invention.

For example, other possible layouts include four octaves in a Minor base Key, where Chromatic key numbers 4 and 5 would swap positions as well as 9 and 10. The benefit of swapping MCKFCMI keys to play in Minor Keys would be to achieve close proximity of likely notes. The problem is that changing keys around like this just to play in a Minor Key might well be a bit confusing and harder to master than the benefit it would provide. On the whole, it is thought best to keep the MCKFCMI keys in a fixed Major format for the sake of consistency. The drawback to keeping the keys fixed into a Major format is that it will require extra finger dexterity to play likely combinations in Minor Keys, but compared to many other musical instruments (like the guitar) this seems a minor drawback in comparison. In any case, Minor Keys can be achieved with a simple re-mapping of a few notes for those who wish to do so, and all such variations should be considered to be included in this present invention.

Figure 5:
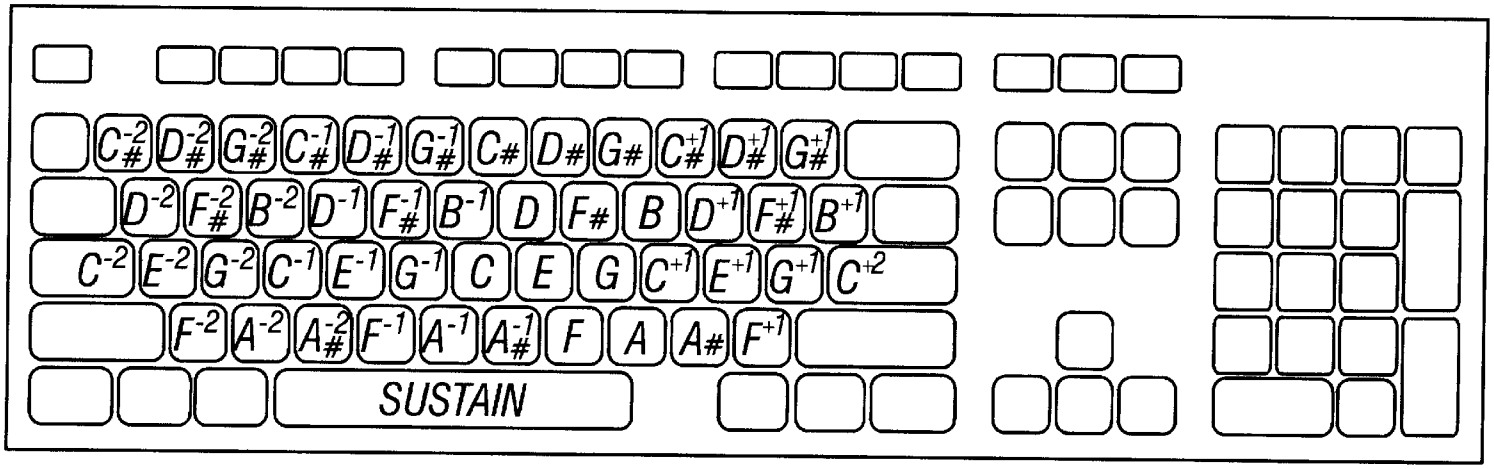
FIG. 5 is an exemplary illustration of FIG. 3 in the specific music KEY of C Major according to one exemplary embodiment of the present invention.
Figure 6:
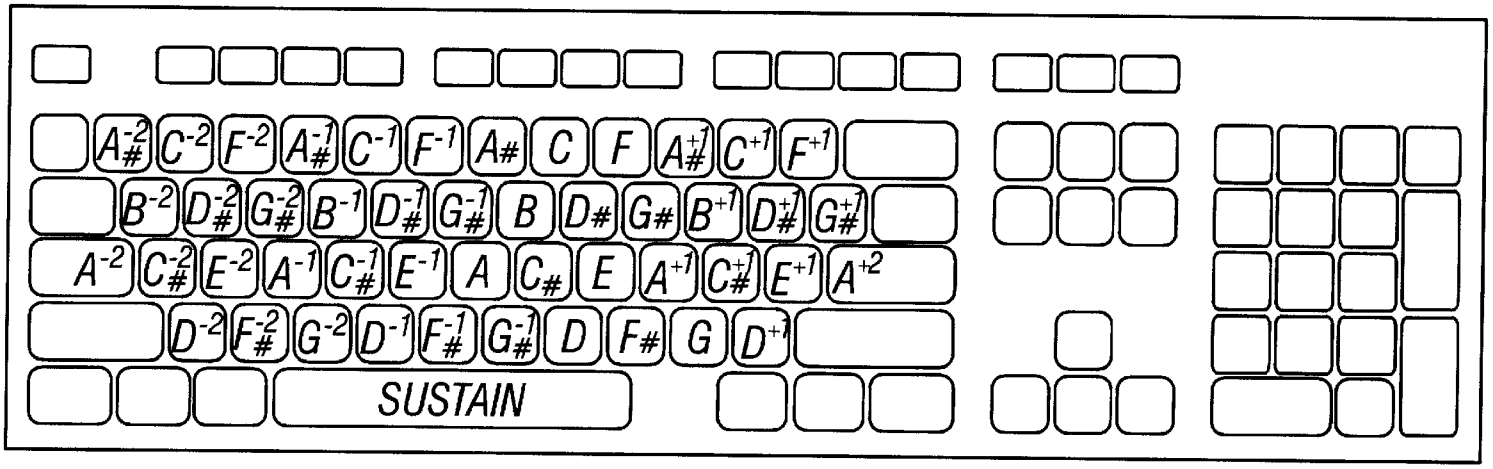
FIG. 6 is an another exemplary. illustration of FIG. 3 in the specific music KEY of A Major according to one exemplary embodiment of the present invention.

FIG. 4 is a diagram illustrating the terminology used in this patent and the mapping strategy described herein and in FIGS. 3, 5 and 6, showing how these relate to various musical notation conventions for one exemplary embodiment of-the present invention.

This patent uses terminology that is common to musicians and music theory in general. For the sake of clarity FIG. 4 cross-references various musical note designation schemes.

The first column of the table in FIG. 4 represents the Halfsteps in a the Chromatic scale. The second column illustrates the generic note name for the Major notes in the Chromatic scale for the sake of cross-reference for those familiar with these designations. The third column represents the Diatonic scale degree of the Major notes based on common music theory notation. The fourth column provides the Key name, i.e. the relationship of the Key to the Tonic Key, which designation is often used in chord progression. The fifth column provides an example of what each note would actually be in the Key of C, and the sixth column shows the same for the Key of A.

Looking across the table, the notes for Chromatic 1, 5, and 8, correspond to the Solfege do, mi, and sol, and to Diatonic I, iii, and V, and to the base notes of Keys Tonic, Mediant, and Dominant, respectively. In the specific Key of C, for example, these notes end up being C, E and G, and in the Key of A these end up being A, C# (# denotes a Sharp note), and E.

FIG. 5 is an exemplary diagram illustrating the keyboard mapping of the present invention into the specific Key of C Major. As shown in FIG. 5, a user's hand position will be over the notes $E^{-2}$, $G^{-2}$, $C^{-1}$, $E^{-1}$ for the left hand; and E, G, $C^{+1}$, $E^{+1}$ for the right hand in the normal "home" position. Thus, if a user wishes to play a Major chord, or arpeggio along a Major chord, then the notes desired are all along the home row. Similarly, if the user wishes to play a Dominant chord, the user need only press notes G, D, and B; where G is in the home row and D and B are just one row up. The Subdominant chord is comprised of F, A, and C; where C is in the home row and F and A are just one row down. The present invention places these notes in positions that are readily accessible by a user who is familiar with the placement of his hands for standard typing.

FIG. 6 is an example of the same for the Key of A Major. The user may start off in any Key desired or change which Key to transpose the home keys to during use by one or more of the following methods configurable by the user:

1) Relative: use of a control key and then hitting the current MCKFCMI mapped Key note desired;
2) Actual: use of a command key and hitting the QWERTY alpha-numeric Key desired, where Sharp or Flat keys are accessed by additional command keys;
3) Function: use of peripheral keys outside the center to transpose to the desired Key, either by a simple up/down function or by mapping targeted common Keys to specific unused keys;
4) Sequence: use patch sequences (which are accessed by various means) that could include MCKFCMI Key changes. Sequence changes can be input using a peripheral device such as a pedal or by using un-mapped MCKFCMI keys or key combination; and,
5) Default: use a user specified Key upon startup.

By pressing the appropriate key or series of keys to change the musical Key of the musical notes, the home keys are changed to be in a different base/Tonic Key and the entire keyboard shifts up or down, but the essential pattern remains the same. The user may then continue to play the musical keyboard of the present invention in the same manner as before the Key change except that the output produced based on the user's keystrokes will be in a different musical Key. FIGS. 5 and 6 are example of this for the Keys of C and A.

In addition to the keys for playing musical notes in accordance with the musical note mapping of the present invention, the mapping may further include function keys, such as the musical key change key described above, to perform various functions for changing the musical output generated by actuation of keys on the keyboard. Such functions keys may include, for example, a sustain key, an all octave-up or down key, a treble octave-up or down key, a bass octave-up or down key, a Key change key, a patch sound key, a stack sound key, a chorus key, a reverb key, a start/stop recordation key, a start-stop loop key, a volume up/down key, a mute key, and the like.

The functions performed in response to actuation of these keys is rather straight forward. For example, the sustain key holds the decay of the notes played out longer just as the sustain pedal on a piano would. The treble octave up key raises the treble output one octave. The treble octave down key lowers the treble output one octave. The bass octave up and bass octave down keys perform similar functions for the bass output. The all octave up key and all octave down keys perform similar functions to both the treble and the bass hands and outputs. The musical Key change key is used to change the Key of the notes in the musical mapping. The patch sound key selects which instrument sound or group of sounds is desired (where "patch" harks back to the early synthesizers which used patch-cords to create sounds). The stack sound key allows a layering of sounds to be played simultaneously with a single key. The chorus, reverb, and start-stop loop keys are all used to perform various transformations of the musical output in a manner generally known in the art of musical synthesizer devices. And, obviously, the volume up/down key and mute key may be used to change the volume of the musical output. Functions such as these would be assigned default locations based on a similar strategy to the note mapping based oh musical use and finger dexterity access. But since it is intended for such functions to be completely programmable and locatable by the user they are not shown in the Figures excepting the example of using the space bar for sustain to give the general idea of how peripheral keys might be used.

Mouse, trackball, and trackpad functions may also be used for music functions such as pitch bend; vibrato control; setting relative sound levels when multiple instruments "patches" are played simultaneously (or stacked); controlling volume, balance or fade; or sequence control through clicks. All of the functions performed in response to the actuation of these function keys and/or peripherals are generally known in the art and thus, a detailed explanation of how the musical output signals are transformed in response to actuation of these keys will not be provided.

In addition to the above, the keyboard of the present invention will have a designated key for changing modes from a standard computer keyboard input mode to MCKFCMI mode and back in accordance with the present invention. This mode selection key would not be part of the applied musical mapping since the musical mapping of the present invention is only used when the standard computer keyboard is operating in MCKFCMI mode. It will serve rather as an enter/exit MCKFCMI mode.

Figure 7:
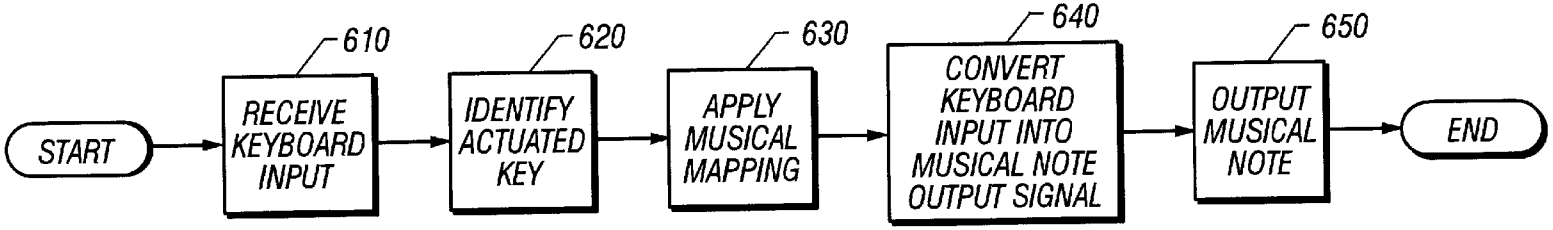
FIG. 7 is a flowchart outlining an exemplary operation of the present invention.

FIG. 7 is a flowchart outlining an exemplary operation of the present invention. As shown in FIG. 7, the operation starts with receiving a keyboard input from the actuation of a key on the keyboard (step 610).

The key that was actuated is determined (step 620) and the musical mapping of the present invention is applied to the keyboard input (step 630). The keyboard input is converted into a musical note output based on the keyboard mapping (step 640). The musical note output is sent to an audio output device which then outputs the musical note (step 650). The operation then ends.

The operation outlined in FIG. 7 may be performed with each actuation of a key on the keyboard. Furthermore, if multiple keys are actuated approximately simultaneously, the operation of FIG. 7 is performed for each of the actuated keys at approximately the same time. Thus, the musical output will be a combination of each of the musical notes generated by actuation of the various keys. In this way, a user may generate a musical chord to be output. The user may decide to have notes output as soon as the computer perceives they are being pressed, or to "group" notes played within a certain granularity of time (that can be programmed) to create simultaneity of output with imperfect input, if desired.

Although not shown in FIG. 7, some keys on the keyboard may have functions associated with them other than the output of a musical note, as described above. When such keys are actuated, the corresponding functions are initiated in the processor of the present invention.

Thus, the present invention provides a mechanism for mapping the keyboard strokes of a user of a standard computer keyboard into musical notes and controls that may be output. In this way, the user may "play" the standard computer keyboard as a real-time musical instrument. As a result, the user need not purchase expensive musical instruments and need not learn how to play such a musical instrument. The present invention allows a user to operate a standard computer keyboard in substantially the same manner as the user is already accustom to and be able to generate real-time musical output .of sounds spanning a range of octaves similar to that of external MIDI piano/organ keyboards.

The present invention is also a means to input musical melodies, chords, scores, bass-lines, percussion, improvisations, etc. into computer musical arrangement programs and the like.

It is important to note that while the present invention has been described in the context of a fully functioning data processing system, those of ordinary skill in the art will appreciate that the processes of the present invention are capable of being distributed in a form of a computer readable medium of instructions and a variety of forms and that the present invention applies equally regardless of the particular type of signal bearing media actually used to carry out the distribution. Examples of computer readable media include recordable-type media such as a floppy disc, a hard disk drive, a RAM, and CD-ROMs and transmission-type media such as digital and analog communications links.

While normally MCKFCMI played sounds will be computer generated, once musicians gain MCKFCMI skill and virtuosity the present invention could be used to control/play traditional, physical instruments via external actuators. A prior-art analogy would be the pipe-organ, where a traditional piano-like keyboard controls the actuation of air pipe horns.

The description of the present invention has been presented for purposes of illustration and description, but is not limited to be exhaustive or limited to the invention in the form disclosed. Many modifications and variations will be apparent to those of ordinary skill in the art.

For example, a possible variation is to span 3 octaves rather than 4 for the purpose of avoiding use of the numbers in QWERTY. In other words, instead of a 12 Chromatic tone keys being placed three wide and four high as depicted, the 12 Chromatic tones would be placed 4 keys wide and 3 key rows high, not using the top row of keys. Such a mapping would place all possible Chromatic notes in closer proximity from the point of view of vertical finger dexterity, but this will of necessity be offset by more required movement horizontally. It will also not cover as many octaves overall.

The embodiment was chosen and described in order to best explain the principles of the invention, the practical application, and to enable others of ordinary skill in the art to understand the invention for various embodiments with various modifications as are suited to the particular use contemplated. While the invention has been particularly shown and described with reference to a preferred embodiment, it will be understood by those skilled in the art that various changes in form and detail may be made therein without departing from the spirit and scope of the invention.

What is claimed is:

1. A method of outputting musical notes with a computer keyboard, comprising:

mapping keys of the computer keyboard to musical notes;

identifying an actuation of at least one key of the standard computer keyboard; and outputting a musical note based on the at least one key that is actuated and the mapping of the keys, wherein the step of mapping keys includes mapping keys such that musical notes that are most often played in musical compositions are mapped to keys in a home row of the computer keyboard, and wherein a pattern of the mapped keys completes a musical octave in three keys horizontally and four keys vertically, wherein the pattern repeats itself across the computer keyboard two or more times.

2. The method of claim 1, wherein the step of mapping keys further includes mapping keys such that musical notes that are second most often to be played in musical compositions arc mapped to keys adjacent to the home row.

3. The method of claim 1, wherein mapping of other musical notes that are not most often played in musical compositions, is performed based on a relative probability that the other musical notes will be played in conjunction with the musical notes that are most often played in musical compositions.

4. The method of claim 1, further comprising mapping one or more peripheral or function keys to the keys of computer keyboard, wherein the peripheral or function keys are used to initiate a change in the musical note that is output.

5. The method of claim 4, wherein the one or more function keys include at least one of a treble octave up key, a treble octave down key, a bass octave up key, a bass octave down key, all octave up key, all octave down key, a musical Key change key, patch sound key, stack sound key, a chorus key, a reverb key, a sustain key, a start/stop recordation key, a volume up/down key, and a mute key.

6. The method of claim 1, wherein the method is implemented in a stand-alone computer keyboard.

7. A method of outputting musical notes with a computer keyboard, comprising:

mapping keys of the computer keyboard to musical notes;

identifying an actuation of at least one key of the standard computer keyboard; and outputting a musical note based on the at least one key that is actuated and the mapping of the keys, wherein the step of mapping keys includes mapping keys such that musical notes that are most often played in musical compositions are mapped to keys in a home row of the computer keyboard, wherein the mapping of musical notes in the home row includes the Diatonic note I (do) and at least one of the musical notes iii (mi) or V (sol), and wherein a pattern of the mapped keys completes a musical octave in three keys horizontally and four keys vertically, wherein the pattern repeats itself across the computer keyboard two or more times.

8. An apparatus for outputting musical notes with a computer keyboard, comprising:

a keyboard having a plurality of actuatable keys;

a processor coupled to the keyboard; and an audio output device coupled to the processor, wherein the processor identifies an actuation of at least one key of the plurality of keys, maps the at least one key of the computer keyboard to a musical note, and instructs the audio output device to output the musical note, wherein the processor maps the at least one key using a musical mapping wherein musical notes that are most often to be played in musical compositions are mapped to the home row of the computer keyboard, and wherein a pattern of the mapped keys completes a musical octave in three keys horizontally and four keys vertically, wherein the pattern repeats itself across the computer keyboard two or more times.

9. The apparatus of claim 8, wherein the musical mapping further includes mapping keys such that musical notes that are second most often to be played in musical compositions are mapped to keys in one of a row above the home row and a row below the home row.

10. The apparatus of claim 8, wherein mapping of other musical notes that are not most often played in musical compositions, is performed based on a relative probability that the other musical notes will be played in conjunction with the musical notes that are most often played in musical compositions.

11. The apparatus of claim 8, wherein the musical mapping maps one or more function keys to the keys of computer keyboard, wherein the function keys are used to initiate a change in the musical note that is output.

12. The apparatus of claim 11, wherein the one or more function keys include at least one of a treble octave up key, a treble octave down key, a bass octave up key, a bass octave down key, all octave up key, all octave down key, a musical Key change key, patch sound key, stack sound key, a chorus key, a reverb key, a sustain key, a start/stop recordation key, a volume up/down key, and a mute key.

13. The apparatus of claim 11, wherein the apparatus is a stand-alone computer keyboard.

14. The apparatus of claim 11, wherein the apparatus is distributed between a computer keyboard and a computing device.

15. An apparatus for outputting musical notes with a computer keyboard, comprising:

a keyboard having a plurality of actuatable keys;

a processor coupled to the keyboard; and an audio output device coupled to the processor, wherein the processor identifies an actuation of at least one key of the plurality of keys, maps the at least one key of the computer keyboard to a musical note, and instructs the audio output device to output the musical note, wherein the processor maps the at least one key using a musical mapping wherein musical notes that are most often to be played in musical compositions are mapped to the home row of the computer keyboard, wherein the mapping of musical notes in the home row includes the Diatonic note I (do) and at least one of the musical notes iii (mi) or V (sol), and wherein a pattern of the mapped keys completes a musical octave in three keys horizontally and four keys vertically, wherein the pattern repeats itself across the computer keyboard two or more times.

16. A computer program product in a computer readable medium for outputting musical notes with a computer keyboard, comprising:

first instructions for identifying an actuation of at least one key of the computer keyboard;

second instructions for mapping the at least one key of the computer keyboard to a musical note; and third instructions for outputting the musical note, wherein the second instructions include instructions for using a musical mapping wherein musical notes that are most often played in musical compositions are mapped to keys in a home row of the computer keyboard, and wherein a pattern of the mapped keys completes a musical octave in three keys horizontally and four keys vertically, wherein the pattern repeats itself across the computer keyboard two or more times.

17. The computer program product of claim 16, wherein the musical mapping further includes mapping keys such that musical notes that are second most often to be played in musical compositions are mapped to keys in one of a row above the home row and a row below the home row.

18. The computer program product of claim 16, wherein mapping of other musical notes that are not most often played in musical compositions, is performed based on a relative probability that the other musical notes will be played in conjunction with the musical notes that are most often played in musical compositions.

19. The computer program product of claim 16, further comprising mapping one or more peripheral or function keys to the keys of computer keyboard, wherein the peripheral or function keys are used to initiate a change in the musical note that is output wherein the one or more function keys include at least one of a treble octave up key, a treble octave down key, a bass octave up key, a bass octave down key, all octave up key, all octave down key, a musical Key change key, patch sound key, stack sound key, a chorus key, a reverb key, a sustain key, a start/stop recordation key, a volume up/down key, and a mute key.

20. A computer program product in a computer readable medium for outputting musical notes with a computer keyboard, comprising:

first instructions for identifying an actuation of at least one key of the computer keyboard;

second instructions for mapping the at least one key of the computer keyboard to a musical note; and third instructions for outputting the musical note, wherein the second instructions include instructions for using a musical mapping wherein musical notes that are most often played in musical compositions are mapped to keys in a home row of the computer keyboard, wherein the mapping of musical notes in the home row includes the Diatonic note I (do) and at least one of the musical notes iii (mi) or V (sol), and wherein a pattern of the mapped keys completes a musical octave in three keys horizontally and four keys vertically, wherein the pattern repeats itself across the computer keyboard two or more times.

* * * * *